US005207076A

United States Patent [19]

Sciarrillo

[11] Patent Number: 5,207,076

[45] Date of Patent: May 4, 1993

[54] PITCHER COOLER

[76] Inventor: Gerald Sciarrillo, 2616 Aein Rd., Orlando, Fla. 32767

[21] Appl. No.: 876,038

[22] Filed: Apr. 30, 1992

[51] Int. Cl.[5] ..... F25D 3/08

[52] U.S. Cl. ..... 62/457.4; 62/530; 220/737; 220/903

[58] Field of Search ..... 62/457.3, 457.4, 529, 62/530; 220/400, 737, 739, 903

[56] References Cited

U.S. PATENT DOCUMENTS

| | | | |
|---|---|---|---|
| 3,089,317 | 5/1963 | Bufalini | 62/457.4 |
| 4,183,226 | 1/1980 | Moore | 62/457.4 |
| 4,299,100 | 11/1981 | Crisman et al. | 62/457.4 |
| 4,606,523 | 8/1986 | Statz et al. | 220/737 X |
| 4,793,149 | 12/1988 | Riche | 62/530 X |
| 4,989,418 | 2/1991 | Hewlett | 62/457.4 |

FOREIGN PATENT DOCUMENTS

| | | | |
|---|---|---|---|
| 1528784 | 4/1967 | France | 220/400 |

*Primary Examiner*—William E. Tapolcai

*Attorney, Agent, or Firm*—James H. Beusse

[57] ABSTRACT

The present invention comprises an apparatus for cooling liquid held in a vessel having an externally extending handle. The apparatus comprises a double-walled container having an inner wall and an outer wall radially spaced apart. The inner wall and outer wall are sealingly attached to a generally flat base member. Each of the inner and outer walls extend generally arcuately about the base member and defines a slot extending substantially perpendicular from the base member. The ends of the inner wall are sealingly connected to the ends of the outer wall adjacent the slot and edges of the inner and outer walls distal from the base member are sealingly attached one to the other for defining a closed space between the inner and outer walls. A refrigerant coolant is disposed in the closed space for maintaining the container at a predeterminately cool temperature for a determinable time interval. The vessel is removably positionable in the container with the handle extending through the slot.

6 Claims, 1 Drawing Sheet

PITCHER COOLER

BACKGROUND OF THE INVENTION

The present invention relates to storage vessels for cooling liquid contents of a removable container having an extending handle such as a pitcher or stein.

The prior art has disclosed double-wall containers for use in cooling or maintaining the temperature of a liquid stored therein. The earliest form of such storage containers is commonly known as a Thermos® bottle or vacuum bottle and serves primarily to maintain temperature. Containers which can cool are constructed similar to such vacuum bottles but utilize a coolant material, such as propylene glycol, held in isolation between the double-walls. In the use of this latter type container, the container is placed in a freezer or cooler to reduce the temperature of the coolant. The container is then removed from the cooler and the consumable liquid poured into the container. Heat transfer occurs between the liquid and the coolant thereby cooling the liquid. In other forms of this latter type of container, the container is sized and shaped for receiving another liquid holding vessel, such as a soda can. The contents of the can are cooled in the can and the liquid consumed by lifting the can from the container by its rim. An example of the latter type container is shown in U.S. Pat. No. 3,205,678.

While the prior art has disclosed various forms of double-wall coolers, it is not believed that nay of the coolers are particularly useful in cooling vessels having a handle, for example, a beer stein or a pitcher. An object of the present invention is to provide a double-wall, coolant holding container suitable for cooling liquid held in a vessel having a handle extending from a side thereof.

SUMMARY OF THE INVENTION

The present invention comprises an apparatus for cooling liquid held in a vessel having an externally extending handle. The apparatus comprises a double-walled container having an inner wall and an outer wall radially spaced apart. The inner wall and outer wall are sealingly attached to a generally flat base member. Each of the inner and outer walls extend generally arcuately about the base member and defines a slot extending substantially perpendicular from the base member. The ends of the inner wall are sealingly connected to the ends of the outer wall adjacent the slot and edges of the inner and outer walls distal from the base member are sealingly attached one to the other for defining a closed space between the inner and outer walls. A refrigerant coolant is disposed in the closed space for maintaining the container at a predeterminately cool temperature for a determinable time interval. The vessel is removably positionable in the container with the handle extending through the slot.

BRIEF DESCRIPTION OF THE DRAWINGS

For a better understanding of the present invention, reference can be made to the following detailed description taken in conjunction with the accompanying drawings in which.

DETAILED DESCRIPTION

Figure 1:
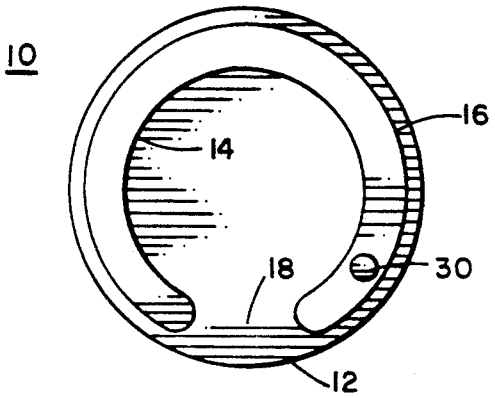
FIG. 1 is a top plan view of a double-wall container in accordance with the present invention.
Figure 2:
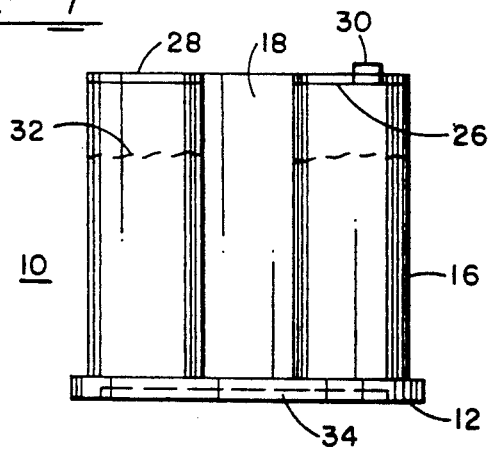
FIG. 2 is a side elevation view of the container of FIG. 1.
Figure 3:
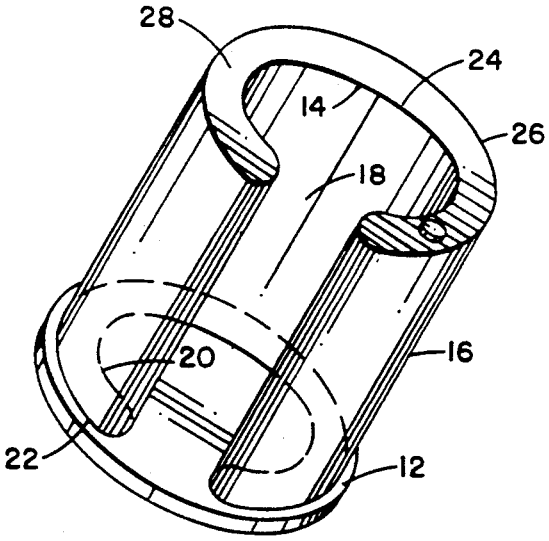
FIG. 3 is a perspective view of the container of FIG. 1.

Referring to FIGS. 1, 2 and 3 generally,

FIG. 1 is a top plan view, FIG. 2 is an elevation view and FIG. 3 is a perspective view of a double-wall container 10 having a base 12 supporting an inner wall 14 and an outer wall 16. The inner and outer walls 14 and 16, respectively, are radially spaced apart and extend generally arcuately about the base 12. Each of the walls 14, 16 terminate short of fully encircling the base 12 so as to define a slot 18 extending from base 12 to a top surface of the walls. The inner wall ends are joined to the outer wall ends adjacent slot 18.

The edges 20, 22 of walls 14, 16, respectively, are sealingly bonded to base 12 by means well known in the art, such as, for example, by use of an epoxy resin bondable to the material of which the container 10 is manufacturer. Preferably, the container 10 is formed of a conventional thermoplastic. The distal edges 24,26 of walls 14,16 are sealingly bonded to an upper cover 28 so that a closed space is formed between walls 14,16. Preferably, the closed space is at least partially filled with a coolant such as propylene glycol, which can transfer a significant amount of heat energy without substantial temperature change. However, the coolant for some applications may constitute water. If a coolant having substantial volume change during temperature variation, e.g., water, is used, it may be desirable to produce one of the walls 14,16 from a non-rigid thermoplastic material to accommodate expansion.

In one form, the container 10 may include a filler cap 30 through which the coolant, indicated at 32, may be poured. For some types of coolant which freeze uniformly or for which the frozen temperature produces only a slush, the walls 14, 16 may be a rigid plastic and sufficient air space left between the level of coolant and the upper cover 28 to accommodate expansion. For other coolants, the inner wall 14 may be relatively rigid and the outer wall 16 may be non-rigid. A rigid inner wall 14 maintains the inner diameter of the container 10 for accommodating predetermined sizes of mugs, steins and pitchers.

Figure 4:
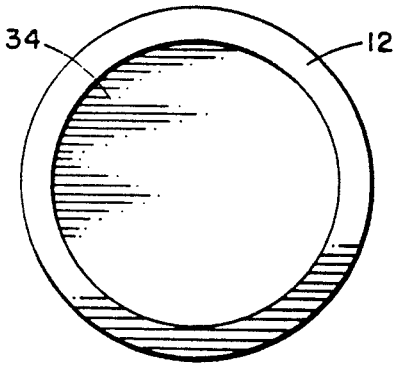
FIG. 4 is a bottom view of the container of FIG. 1.

Referring to FIG. 4, there is shown a bottom view of base 12 which, when considered with FIG. 2, can be seen to have a recessed bottom, indicated by line 34. The recessed bottom minimizes the flatness requirement of the bottom surface for setting securely on a flat surface.

Figure 5:
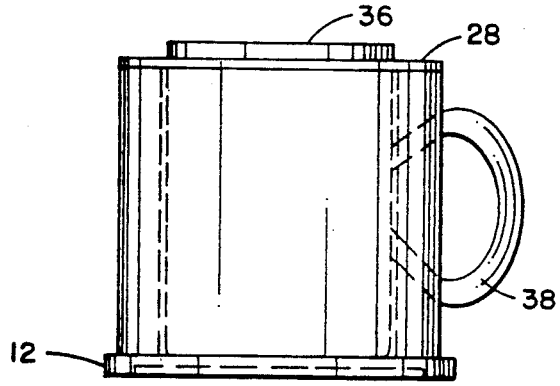
FIG. 5 is an illustration of the use of the invention in holding a liquid vessel.

Referring to FIG. 5, in use, the closed-space between walls 14 and 16 of container 10 is filled at least partially with a refrigerable coolant. The container 10 is then placed in a freezer or other cooler to reduce the temperature of the coolant to a predetermined value. Upon removal from the freezer, the container 10 is ready to receive a mug or pitcher of preselected size which fits within the inner space defined by wall 14. The mug or pitcher 36 is inserted such that its handle 38 protrudes through slot 18. The pitcher 36 and its liquid contents are cooled by heat transfer from the liquid to the coolant. The liquid can thereby be kept in a relatively cool state without the use of ice for relatively long time intervals. The pitcher 36 is easily removed and reinserted in container 10 by merely grasping the handle 38 and moving the pitcher vertically.

While various coolants having low thermal expansion are commercially available, it may be desirable for safety and convenience to use water as a coolant. While producing one wall 14, 16 from a non-rigid thermoplastic will allow for water expansion during freezing, it may also be possible to use water merely by providing sufficient expansion volume within the closed space between walls 14, 16, i.e., by limiting the amount of water in the space. However, the walls 14, 16 would necessarily be formed of a relatively strong thermoplastic to accommodate side pressure. Accordingly, it is anticipated that plastics such as LEXAN polycarbonate may be employed in production of container 10.

While the invention is illustrated in a preferred form, various modification may become apparent to those of ordinary skill in the art. It is intended therefore that the invention be interpreted within the full spirit and scope of the appended claims.

What is claimed is:

1. Apparatus for cooling liquid held in a vessel having an externally extending handle, the apparatus comprising a double-walled container having an inner wall and an outer wall radially spaced apart, said inner wall and outer wall being sealingly attached to a generally flat base member, each of said inner and outer walls extending generally arcuately about said base member and defining a slot extending substantially perpendicularly from said base member, ends of said inner wall being sealingly connected to ends of said outer wall adjacent said slot and edges of said inner and outer walls distal from said base member being sealingly attached one to the other for defining a closed space between said inner and outer walls, a refrigerant coolant disposed in said closed space for maintaining said container at a predeterminately cool temperature for a determinable time interval, the vessel being removably positionable in said container with the handle extending through said slot.

2. The apparatus of claim 1 and including filler means for pouring said coolant into said closed space.

3. The apparatus of claim 1 wherein at least one of said inner and outer walls comprises a non-rigid plastic material.

4. The apparatus of claim 3 wherein said coolant comprises water.

5. The apparatus of claim 1 wherein said base member includes a partially recessed bottom surface.

6. The apparatus of claim 1 wherein said vessel comprises a pitcher, said slot being just sufficiently wide to pass said handle such that a maximum surface area of said pitcher is positioned adjacent said inner wall of said container.

* * * * *